US005123612A

United States Patent [19]

Labroche et al.

[11] Patent Number: 5,123,612

[45] Date of Patent: Jun. 23, 1992

[54] PROJECTILE AND PROCESS FOR ITS USE

[75] Inventors: Jean-Paul Labroche, St. Aubin; Guy-André Tonnerre, Olivet; Daniel Wisshaupt, Orleans, all of France

[73] Assignee: Thomson-Brandt Armements, Boulogne Billancourt, France

[21] Appl. No.: 643,749

[22] Filed: Jan. 22, 1991

[30] Foreign Application Priority Data

Jan. 26, 1990 [FR] France ..... 90 00943

[51] Int. Cl.[5] ..... F42B 10/66; F42B 12/10

[52] U.S. Cl. ..... 244/3.22; 102/476

[58] Field of Search ..... 244/3.22; 102/476

[56] References Cited

U.S. PATENT DOCUMENTS 4,657,208 4/1987 Miller, Jr. et al. ..... 102/476
4,907,485 3/1990 Westphal et al. ..... 102/476

FOREIGN PATENT DOCUMENTS 0162250 11/1985 European Pat. Off. .
0229541 7/1987 European Pat. Off. .
2425049 11/1979 France .
2519752 7/1983 France .
2612288 9/1988 France .
2633383 12/1989 France ..... 102/476
2002885 2/1979 United Kingdom .
2149066 6/1985 United Kingdom ..... 102/476

*Primary Examiner*—Charles T. Jordan
*Attorney, Agent, or Firm*—Roland Plottel

[57] ABSTRACT

Anti-tank projectile with initial direct firing in overflight.

This projectile comprises a device for detection of the instant of arrival in the vicinity of the target, this device acting on a sequencer which commands first the ignition of a first booster, situated at the front of the projectile and causing it to turn in a clockwise direction, its braking, and the curving of its trajectory towards the target, and then the ignition of a second booster, which being placed at the rear of the projectile, stops its turning motion. The impact on the target is then frontal.

13 Claims, 2 Drawing Sheets

PROJECTILE AND PROCESS FOR ITS USE

BACKGROUND OF THE INVENTION

The present invention concerns a projectile, for example an anti-tank projectile, and a process for its use.

The development of the protection of tanks, today's major combat vehicles, at present makes infantry attack by traditional means more and more difficult. More particularly, the shoulder-fired weapons used by foot-soldiers almost all use warheads based on the principle of the hollow charge. This technology is countered at present, and to an ever-increasing degree, by multiple layers of armor whose role is precisely to disturb the operation and thus reduce the effectiveness of the jets from hollow charges. An improvement of performances against these targets is possible, but these new armors are becoming progressively harder and more effective, which means that any marginal improvement in the performances of present warheads is likely to be complex and costly if the calibers and weights compatible with a portable weapon are to be respected, all the more so for a weapon with a given caliber of munitions (missiles, tank artillery munitions, etc.).

However, these protections are placed by priority on the parts of the target most exposed to direct fire anti-tank projectiles, which is at present the simplest method of attack. Today, only the relatively weak protection of the roof and floor of armored vehicles allows any potential for development of anti-armor weapons.

Since attack via the floor seems impractical using an infantry weapon, attack via the roof remains the only method to be envisaged, and a few solutions using this principle have already been investigated recently, including:

The use of a projectile with a direct trajectory overflying the target and, on passing over the target, firing of a shaped charge (hollow charge or slug-generating charge). The slug-generating charge, however, has only limited effectiveness against armor, even the armor on the roof of a tank. The hollow charge, on the other hand, is in principle perfectly able to pierce the armor on the roof of a tank. Unfortunately, in this case, we must take into account the fact that the jet of a hollow charge moves during firing in the same direction as the projectile carrying it: the jet is displaced laterally as it hits the target, and there is a high risk of non-penetration. It has been suggested, to remedy this disadvantage, that the projectile could be made to turn during the jet in order to maintain the impact of the jet on the same point of the target; such a process is however very difficult to achieve owing to the very high rotation speed which must be imparted to the projectile.

The use of a projectile equipped with a seeker and fired upwards. As it falls, a parachute opens and the projectile then moves so as to scan a certain footprint. The damaging part is then either a slug-generating charge or a sub-projectile fired by a cannon or rocket effect from the initial projectile. Such a system is however complex, and expensive, and is relatively long to bring to operational readiness. It poses problems concerning precision in reaching the target, which is of course in motion. In addition, this system involves firing into the air instead of firing straight at a target, which is psychologically difficult to accept.

The use of piloted or guided projectiles, whose trajectory is made to curve downwards until impact on the top of the target at a high angle of incidence. This process requires the use of a particularly complex and costly device.

SUMMARY OF THE INVENTION

The invention, which aims to remedy these disadvantages, intends to make possible both direct attack via the roof of a tank using a projectile, without having to equip this projectile with sophisticated guidance or detection devices, and firing at ranges and elevations compatible in particular with close infantry anti-tank combat. For this purpose it concerns a projectile for firing in the direction of a target, said projectile comprising:

- a first booster placed in front of the center of gravity of said projectile;
- a second booster placed behind said center of gravity;
- a warhead;
- first means for determining at a given instant the arrival of said projectile in the vicinity of said target;
- second means for then initiating said first booster in order to apply to said projectile a first force $F_1$ directed both towards the rear of said projectile and towards the ground for causing simultaneously the braking of said projectile to facilitate the deviation of its trajectory, the curving of said trajectory in a downwards direction, and the turning of said projectile to keep its longitudinal axis substantially parallel to said trajectory;
- third means for then initiating said second booster in order to apply to said projectile a second force ($F_2$ or $F'_2$) directed so as to counteract said turning while enhancing said curving and maintaining said longitudinal axis in said trajectory; and
- means for triggering said warhead.

In addition, the second booster is preferably arranged in such a way as to create a said second force which, like the first, is in addition inclined with reference to the longitudinal axis of the projectile, but which is directed either towards the front of the projectile if it is wished to accelerate the projectile before impact, or towards the rear of the projectile if it is wished to brake it still more in order to curve its trajectory even more.

BRIEF DESCRIPTION OF THE DRAWINGS

The invention will be well understood, and its advantages and other characteristics will become clear, on reading the following description of a non-restrictive example of embodiment, with reference to the appended schematic diagram in which.

DESCRIPTION OF THE PREFERRED EMBODIMENT

Figure 1:
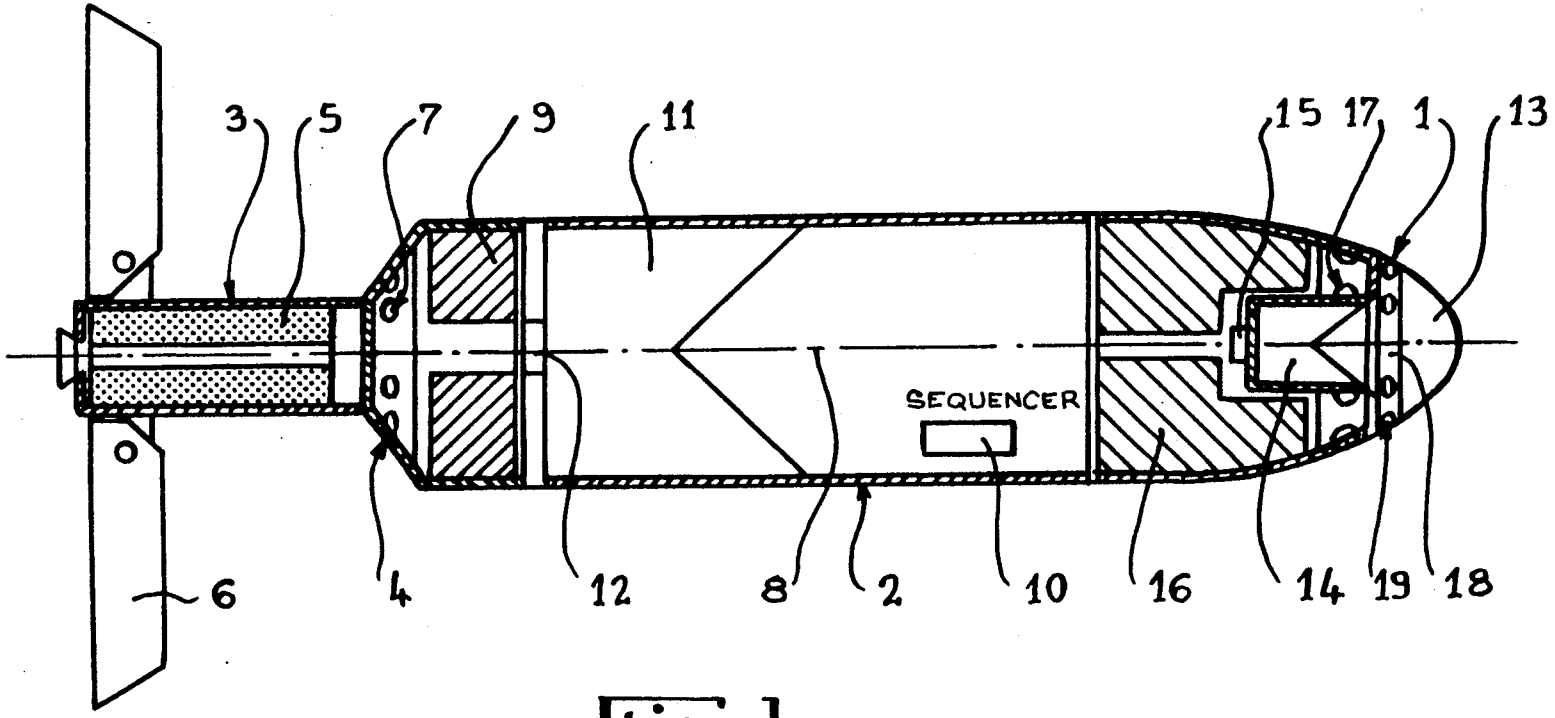
- FIG. 1 is a partial longitudinal section view of this anti-tank projectile.

FIG. 1 shows an anti-tank projectile of caliber small enough to be shoulder fired. Its caliber is of the order of 100 mm, for example. This projectile is composed of a nose cone 1, a main body 2, and a rear propelling part 3 which is connected to the main body 2 by a tapered section 4.

The part 3 conventionally comprises a sustainer engine or a cruising propeller 5 and a deployable tail-fin unit 6 whose opening mechanism on exit from the launch tube is not shown in the drawing.

The tapered section 4 comprises a barrel with six regularly-spaced identical nozzles 7. These nozzles are arranged to emit a driving gas jet which is inclined with respect to the longitudinal axis 8 of the projectile and which is directed towards the rear of the projectile. Moreover, as can be seen on the drawing, this barrel of nozzles 7 is clearly behind the center of gravity of the projectile.

The nozzles 7 are conventionally associated with a gas generator 9, and only one of them is intended to be selected, under the control of an electronic sequencer 10, by the use of obturators of which a single one is then destroyed by a conventional pyrotechnical device (not shown): a pyrotechnical charge is ignited, which generates overpressure which, by a shearing effect, breaks a part obturating the nozzle selected.

The body 2 of the device comprises for example a main hollow charge 11, with its ignition device 12, and the central command computer, or sequencer 10 mentioned above, with its multiple connections (not shown) to the various detection and activation mechanisms contained in the projectile.

According to a possible mode of embodiment, the nose cone 1 conventionally comprises a nose 13 containing an impact detector which causes triggering of the warhead on direct impact of the projectile on the target, and a primary warhead 14 and its associated initiator 15: this warhead is therefore constituted of the parts 11, 12, 14 and 15.

The nose cone 1 also includes:

A gas generator 16 which is associated with another barrel of six nozzles 17, these also being regularly spaced and identical, these front nozzles 17 having the same angular arrangement as the rear nozzles 7 and being selectable in the same way as the latter, using a similar device for pyrotechnical destruction of the obturator: the selection command emitted by the sequencer 10 will therefore simultaneously cause opening of one of the nozzles 7 and of the corresponding nozzle 17 (i.e. that with the same angular position on the transverse circumference defined by each barrel of six nozzles). The nozzles 17 are arranged to emit a propelling gas jet which is inclined relative to the longitudinal axis 8 of the projectile and which is directed towards the front of the projectile. The nozzle barrel 17, being in the nose cone 1, is placed clearly in front of the center of gravity of the projectile.

Sectorial seeker means 18, comprising six sectorial seekers 19 distributed angularly in the same way as the nozzles 17 and 7, with associated optical devices, which supply the computer 10 with the detection and directional information relative to the target which is necessary, as we shall see below, for operation of the projectile.

The operation of this device, which we shall explain with reference to FIGS. 2 to 5, is as follows:

If a sophisticated firing direction system is used, the gunner (not shown) aims at the target 20 using a sighting device which is an integral part of the firing direction system. When his aim is well adjusted, he notes the range of the target 20, selecting a particular part of the roof of the target: the center of the turret bearing or the turret. This instant corresponds to the moment when the computer associated with the launcher (not shown) begins to take command. With the objective of placing the projectile in the vicinity of the target at the moment when it overflies it, minimal tracking of the target is then performed in order to determine its apparent velocity by analysing the angular velocity information obtained. The calculator determines the firing corrections for bearing and elevation, which are then taken into account by the gunner, either by shifting the line of sight or by moving the reticle, and if necessary communicates the firing information to the projectile.

For a simplified firing direction system, the gunner determines the position of the future target by empirical means and adjusts the sight on this point.

In either case, the gunner then squeezes the trigger of the launch tube, so that the projectile is ejected from the tube, opens its tail-fin unit 6 and describes its trajectory, in a direct line practically parallel to the ground 21 and a few meters above it, after ignition of its sustainer engine 5. In this example of embodiment, the projectile is not stabilized in roll, but is on the contrary in free rotation about its longitudinal axis, which is conventionally obtained by inclination of the tail-fin unit 6.

Figure 2:
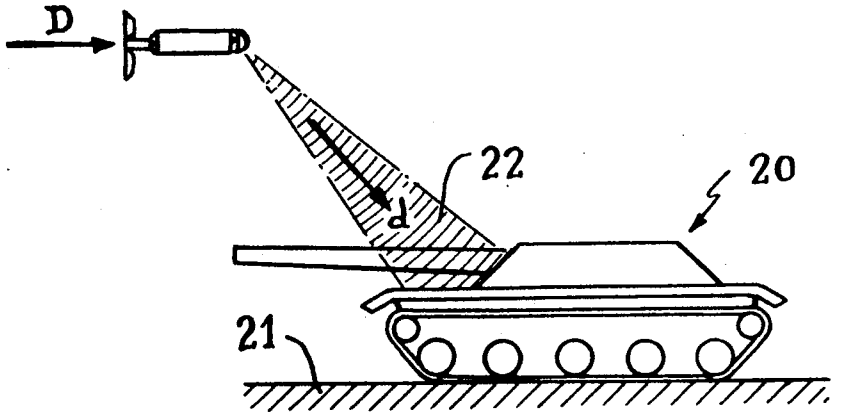
- FIGS. 2 to 5 show the successive phases of operation of this anti-tank projectile.
Figure 3:
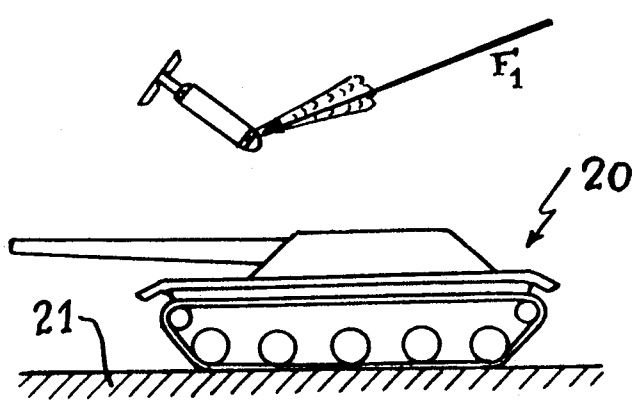
Figure 4:
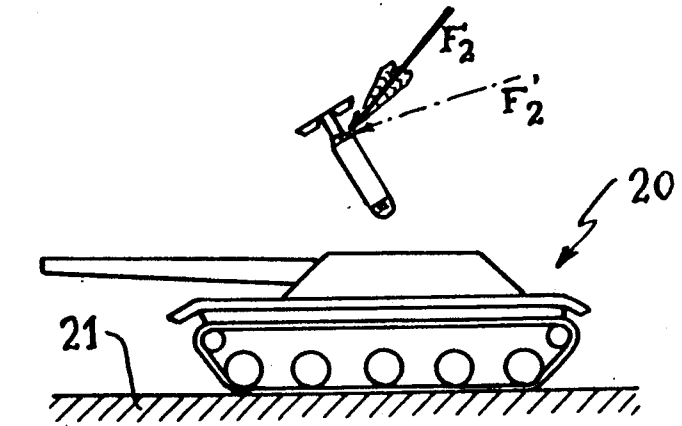
Figure 5:
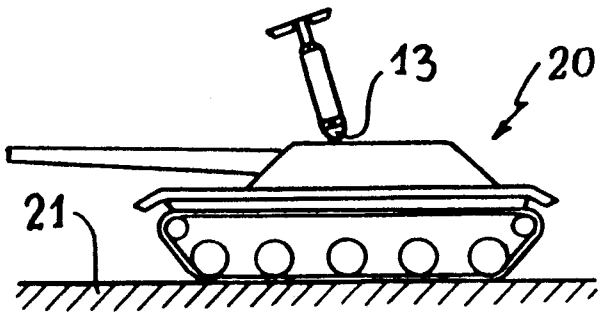

As shown in diagrammatic form in FIG. 2, when the projectile arrives at a distance of a few meters in front of the target 20, one of the six sectorial seekers 19 senses the target in its beam 22 and consequently transmits the information that the target has been detected in a particular sector to the onboard sequencer 10, enabling it to determine the turning plane defined by the initial direction D of this projectile and the center of the detection sector at the moment of detection of the target.

The first booster, i.e. the front booster composed of the nozzles 17 is then ignited by the use of the gas generator 16 and the pyrotechnical device for selection of the correct nozzle (FIG. 3), so as to impart to the projectile a force F1 situated in the abovementioned turning plane, inclined as shown with reference to the longitudinal axis of the projectile, and directed both towards the rear of the projectile and downwards, which gives the following three simultaneous effects:

An effect of braking the projectile, due to the fact that the force F1 communicated to the projectile possesses a component aligned with the vector of velocity but in the opposite direction. This braking effect, by reducing the centrifugal force, reduces the load factor necessary to curve the trajectory, and thus enables a considerable curve over the very short remaining distance (a few meters) to the target.

Curving of the trajectory in a downwards direction, i.e. in the direction of the target 20, by modification of the direction of the velocity vector.

Turning of the projectile downwards about its transverse axis, passing through its center of gravity, this turning being due to the fact that the force F1 is applied at a point situated in front of the center of gravity of the projectile. This turning movement has a tendency to maintain the longitudinal axis of the projectile in alignment with its trajectory, the final objective being to provoke frontal impact on the target by the nose 13 of the projectile.

Immediately after this first booster 17 ceases to operate, the rear booster (or second booster) composed of the nozzles 7 is ignited by the use of the gas generator 9, and the pyrotechnical device for selecting the correct nozzle (FIG. 4), the single nozzle selected being that which corresponds in angular position to the nozzle 17 previously selected on ignition of the first booster. This results in the application to the projectile of another force F2, still situated in the abovementioned turning plane, inclined as shown with reference to the longitudinal axis of the projectile, and directed both towards the front of the projectile and downwards, which causes the following three further simultaneous effects:

Stopping of the turning movement imparted to the projectile by the first booster (this is the main objective of the second booster). Since the force F2 is applied behind the center of gravity of the projectile, it is exerted in the opposite rotational sense to the force F1.

A further downward curving of the trajectory, enhancing the curving created by the first booster.

Acceleration of the projectile to give it a speed of the same order of magnitude as its initial speed, or even greater. It should be noted that the force F2, in another mode of embodiment, could have been determined to be directed towards the rear, as shown by a dotted and dashed line F'2. In this case, the speed would be decreased even more, which presents no disadvantages for certain types of devices and which would have the advantage of curving the trajectory even more to bring it for example to an angle with the horizontal which would be close to 90 degrees.

The projectile is then in the optimal configuration (FIG. 5) for the warhead on impact of its nose 13 on the target 20, the axis of action of the warhead, i.e. the axis of the projectile, then being approximately aligned with the vector of velocity which is itself oriented downwards. The angle with the horizontal can be up to 90 degrees, but a lower value may be chosen, for example about 45 degrees.

Needless to say, the invention is not restricted to the mode of embodiment which has just been described. The use of a projectile in autorotation has the advantage of enabling it to operate even if it does not arrive in the vertical plane in the direction of the target, i.e. if it is fired to pass to the right or left of the target, and not just above it. As the plane of turning is determined by the directions D and d, it is of little importance whether d is in the vertical plane or not. However, the structure of the projectile is then fairly complex, as the sectorial seeker means 18 and the nozzles 7 and 17 must be able to cover an angle of 360 degrees, but it does not require either a system of roll stabilization or a roll sensor. If it can be accepted that the projectile can reach its target only if it is fired to pass just above the target, it is then possible to use a projectile conventionally stabilized in roll (e.g. by a vertical sensor and a simplified roll actuator) so that the projectile comprises only a single pair of nozzles 7, 17 and a single seeker 19, all three directed downwards and in the plane of pitch, which then coincides with the vertical plane. In addition there is then no need for pyrotechnical nozzle selectors, which greatly simplifies the projectile. It should be noted that detection by the part 19 of the passage of the device near the target can if necessary be facilitated by preliminary marking of the target (laser illumination obtained by an extension of the range finding function).

If a roll-stabilized projectile is used, the instant of arrival of this projectile in the vicinity of the target can be determined by other means. For example:

By timing: the delay is calculated as a function of the range of the target. The use of this process requires transmission to the projectile of the information "distance to target".

By equating the measured distance of the target with the calculated distance obtained by integration of the velocity measured on board the projectile. This approach again requires transmission to the projectile of the information "distance to target".

The use of the sustainer engine 5 is of course optional for the embodiment of the invention. It does however enable the sensitivity to wind to be reduced and a constant speed to be maintained on the trajectory D, which has the advantage of maintaining constant dynamic behavior for the turning movement whatever the triggering point chosen on the trajectory. The engine 5 can, in addition, be used as a source of energy for the onboard equipment.

The front booster (17) can be integrated around the primary warhead 14. Its corresponding gas generator 16 must then be annular so as to enable the jet from the main warhead 11 to pass through.

The sectorial seeker means 18 are preferably housed in contact with or in the structure of the front booster (17).

Owing to the inclination of the force vector F1 provided by the front booster, it can be envisaged to use a single nozzle for this booster with a jet whose direction can be controlled in known manner, for example by use of a deflector.

As a variant it is possible to dispense with the directional aspect of the seeker means 18 provided that a vertical reference is available from a specific sensor, and that it is acceptable to attain the target only if the projectile passes vertically over it.

Other variants are that the second booster can be triggered either before the first one ceases to operate, or on the contrary, after a delay following the extinction of the first booster.

What is claimed is:

1. A projectile for firing in the direction of a target, said projectile comprising:

a first booster placed in front of the center of gravity of said projectile;

a second booster placed behind said center of gravity;

a warhead;

first means for determining at a given instant the arrival of said projectile in the vicinity of said target;

second means for then initiating said first booster in order to apply to said projectile a first force $F_1$, directed both towards the rear of said projectile and towards the ground for causing simultaneously the braking of said projectile to facilitate the deviation of its trajectory, the curving of said trajectory in a downwards direction, and the turning of said projectile to keep its longitudinal axis substantially parallel to said trajectory;

third means for then initiating said second booster in order to apply to said projectile a second force ($F_2$ or $F'_2$) directed so as to counteract said turning while enhancing said curving and maintaining said longitudinal axis in said trajectory; and means for triggering said warhead.

2. A projectile as defined in claim 1, wherein said first booster comprises a first barrel of nozzles and said second booster comprises a second barrel of nozzles, the nozzles of each said barrels being distributed to cover an angle of 360 degrees around said longitudinal axis, each nozzle of said first barrel having an angular correspondance with a nozzle of said second barrel.

3. A projectile as defined in claim 1, further comprising a device for roll stabilization, wherein each said booster comprises a single nozzle directed downwards, the nozzle of said first booster having an angular correspondance with the nozzle of said second booster.

4. A projectile as defined in claim 2, wherein said first means comprise a plurality of sectorial seekers, one of which enabling to determine said arrival, each of said sectorial seekers corresponding to one nozzle of said first booster.

5. A projectile as defined in claim 3, wherein said first means comprise a single seeker corresponding to the single nozzle of said first booster, and directed downwards.

6. A projectile according to claim 4, wherein said second means comprise means for selecting the correct nozzle of said first booster which corresponds to the sectorial seeker determining said arrival, and a first gas generator.

7. A projectile according to claim 5, wherein said second means comprise a gas generator.

8. A projectile according to claim 6, wherein said third means comprises means for selecting the nozzle of said second booster which corresponds angularly to said correct nozzle, and a second gas generator.

9. A projectile according to claim 1, wherein said second force ($F_2$) is inclined with reference to said longitudinal axis and is directed towards the front of said projectile for accelerating it.

10. A projectile according to claim 1, wherein said second force ($F'_2$) is inclined with reference to said longitudinal axis, and is directed towards the rear of said projectile for braking it still further to be able better to curve its trajectory.

11. A projectile according to claim 1, further comprising a main body and a nose cone, and wherein said wharhead is constituted of a primary warhead located in said nose cone, and a main warhead located in said main body.

12. A projectile according to claim 11, further comprising a gas generator associated with said first booster, wherein said first booster is integrated around said primary warhead, and wherein said gas generator is annular.

13. A projectile according to claim 1, further comprising a sustainer engine which is in addition used as a source of energy for the projectile.

* * * * *